United States Patent [19]

Nagata et al.

[11] Patent Number: 4,858,391

[45] Date of Patent: Aug. 22, 1989

[54] SIZING APPARATUS FOR AN INTERNAL GRINDER

[75] Inventors: Tetsuya Nagata; Hideki Ohmori, both of Narashino, Japan

[73] Assignee: Seiko Seiki Kabushiki Kaisha, Japan

[21] Appl. No.: 181,546

[22] Filed: Apr. 14, 1988

[30] Foreign Application Priority Data

Apr. 15, 1987 [JP] Japan ..... 62-92489

[51] Int. Cl.[4] ..... B24B 49/00

[52] U.S. Cl. ..... 51/165.93; 51/165.91; 51/165.83; 51/165.88

[58] Field of Search ..... 51/165.93, 165.91, 165.71, 51/165.77, 165.8, 165.83, 165.87, 165.88, 34 E

[56] References Cited

U.S. PATENT DOCUMENTS 4,505,074 3/1985 Kogure ..... 51/165.93

*Primary Examiner*—Frederick R. Schmidt

*Assistant Examiner*—Maurina Rachuba

*Attorney, Agent, or Firm*—Bruce L. Adams; Van C. Wilks

[57] ABSTRACT

Sizing apparatus for an internal grinder having an oscillation motor for oscillating a grinder wheel contacting the inner peripheral surface of an annular work piece, a sizing device to generate sizing signals for measuring the bore of the work piece, a measuring probe connected to the sizing device, a probe position sensor for sensing positions of the measuring probe in an axial direction of the bore of the work piece with reference to a rotation angle of a drive shaft of the oscillation motor, and a sizing signal sampler for sampling sizing signals when positions of the measuring probe are inside the bore of the work piece. The sizing apparatus for an internal grinder is capable of measuring the bore of the work piece during an oscillation machining despite the smallness of the bore and size in the axial direction of the work piece.

8 Claims, 9 Drawing Sheets

SIZING APPARATUS FOR AN INTERNAL GRINDER

BACKGROUND OF THE INVENTION

This invention relates to a sizing apparatus for an internal grinder whereby an oscillation machining of an inner peripheral surface of a work piece can be performed and a bore of the work piece can be measured by means of a sizing device during the oscillation machining.

In FIG. 12, a spindle feeding table 10 (work table) is movable in the direction of Y and a wheel spindle table 12 is movable in the direction of X which is perpendicular to the Y direction. A work piece 14 is supported on the spindle feeding table 10 and a grinding wheel 16 is supported on the wheel spindle table 12.

The grinding wheel 16 is fitted on the tip of a drive shaft of a spindle motor 18, and the inner peripheral surface of the work piece 14 is ground by the grinding wheel 16.

As shown in FIG.. 13, the spindle feeding table 10 is driven in the Y direction by a feeding motor 24 by way of a ball type screw 20 and a speed reducer 22 which are disposed under the table 10, thereby actuating the grinding wheel 16 to grind the inner peripheral surface of the work piece 14.

As shown in FIG. 14, the wheel spindle table 12 is stroked and driven in the X direction by means of a traverse motor 26 and a ball type screw 28 which are disposed under the table 12, and is vibrated by means of an eccentric cam 30 and an oscillation motor 32.

The tips of a pair of forks 36 included in a sizing device 34 arranged on the spindle feeding table 10 are inserted into the work piece 14 from a side of the sizing device nearer the grinding wheel 16, and are pressed toward the inner peripheral surface of the work piece 14, as shown in FIG. 15, 16, 17, 18 and 19.

Positions of the tips of the forks 36 are measured by means of a sizing device 34, and the bore of the work piece 14 is obtained by virtue of the measured positions of the tips.

As shown in FIG. 17 and 18, when the bore of the work piece 14 is small relative to the size of the grinding wheel 16 and, the grinding wheel 16 and the tips of the forks 36 interfere with each other during an oscillation machining, the tips of the forks 36 are inserted into or removed from the work piece 14 by means of an interlocking mechanism 38 relative to an oscillation of the wheel spindle table 12 interlocked therewith.

In an example in FIG. 12, the sizing device 34 is movable in the direction of axis of the work piece 14 (X direction), and is driven forward and backward on a shaft 40 of the interlocking mechanism 38 relative to the work piece 14.

The center portion of the shaft 40 is supported by a guide 42, and the base end of the shaft 40 is fixed on an interlocking member 44.

The interlocking member 44 is driven by a drive member 46 provided on a side of the spindle motor 18 by way of a shaft 48, and is urged in the direction where the tips of the forks 36 are inserted into the work piece 14 by means of a spring 50. The shaft 48 is supported by guides 51 and 53.

A contactless switch 49 is disposed in proximity to the interlocking member 44 on the spindle feeding table 10, and is turned on when the tips of the forks 36 touch the inner peripheral surface of the work piece 14 during an oscillation machining, as shown in FIG. 20.

A switching signal for the contactless switch 49 is used as a size locking signal for sizing signal outputted from the sizing device 34. The sizing signal of the sizing device 34 is invalidated when the contactless switch 49 is off, and is treated as effective only when the contactless switch 49 is on.

Therefore, the sizing signal corresponding to the bore of the work piece 14 is intermittently obtained during an oscillation machining.

Thus, the size locking signal which removes unnecessary portions of the sizing signal and effects only necessary portions thereof is turned on at a time $t_1$ caused by a time of delay $\Delta t$ after the tips of the forks have reached the end surface of the work piece at a time shown with (A) $t_0$ and, is turned off at a time $t_3$ before a time $t_5$ when the tips of the forks retreat from the end surface of the work piece 14, in the case that the wheel spindle table 12 moves at a speed whose oscillation cycle is extremely low, as shown in FIG. 20.

To the contrary, in the case that the wheel spindle table 12 moves at a speed whose oscillation cycle is extremely high, a delay time $\Delta t$ is substantially increased to an non-negligible degree relative to the oscillation cycle, thereby resulting in a delay in a time $t_4$ for turning off the size locking signal.

Namely, a hysteresis always exists in the switching of the contactless switch 49, as shown in FIG. 20 (A), and a shut-off time $t_4$ of the size locking signal moves toward a shut-off time $t_5$ of the sizing signal by means of the sizing device 34.

Therefore, when a length d of the work piece in the axial direction is extremely short, as shown in FIG. 20, a shut-off time $t_4$ of the contactless switch 49 is delayed compared to a time $t_5$ when the tips of the forks 36 retreat from the end surface of the work piece 14, whereby the bore of the work piece 14 cannot be measured.

SUMMARY OF THE INVENTION

This invention aims to overcome the above mentioned problems. It is an object of the invention to provide a sizing apparatus for an internal grinder which is capable of measuring a bore of a work 14 during an oscillation machining despite the smallness of the bore and size in the axial direction of the work piece 14.

In order to achieve the objects described above, a sizing apparatus for an internal grinder according to the present invention comprises: a work table for supporting a work piece to be machined; a wheel spindle table movable in the axial direction of a bore of the work piece; an oscillation motor for oscillating by way of the wheel spindle table a grinding wheel contacting the inner peripheral surface of the work piece; a sizing device to generate sizing signals for measuring the bore of the work piece; a measuring probe connected to the sizing device, and contacting the inner peripheral surface of the work piece; an interlocking mechanism for inserting or removing the measuring probe of the sizing device into or from the work piece by interlocking the wheel spindle table relative to oscillations of the wheel spindle table; a probe position sensing means for sensing positions of the measuring probe of the sizing device in an axial direction of the bore of the work piece with reference to a rotation angle of a drive shaft of the oscillation motor; and a sizing signal sampling means for sampling sizing signals when position of the measuring probe sensed by the probe position sensing means are inside the bore of the work piece.

In an internal grinder according to the present invention, positions of the measuring probe of the sizing device are detected with reference to a rotation angle of the drive shaft of the oscillation motor for vibrating the grinding wheel by way of the wheel spindle table. Then, a sizing signal is treated as effective only during a period of time the measuring probe is confirmed to be contacting the inner peripheral surface of the work piece in the detected position.

BRIEF DESCRIPTION OF THE DRAWINGS

A full understanding of the present invention will be obtained from the detailed description of the preferred embodiment presented hereinbelow, and the accompanying drawings, which are given by way of illustration only and are not intended to be limitative of the present invention, and wherein.

DETAILED DESCRIPTION OF THE PREFERRED EMBODIMENT

A preferred embodiment of a sizing apparatus for an internal grinder according to the present invention will now be described with reference to the accompanying drawings.

Figure 1:
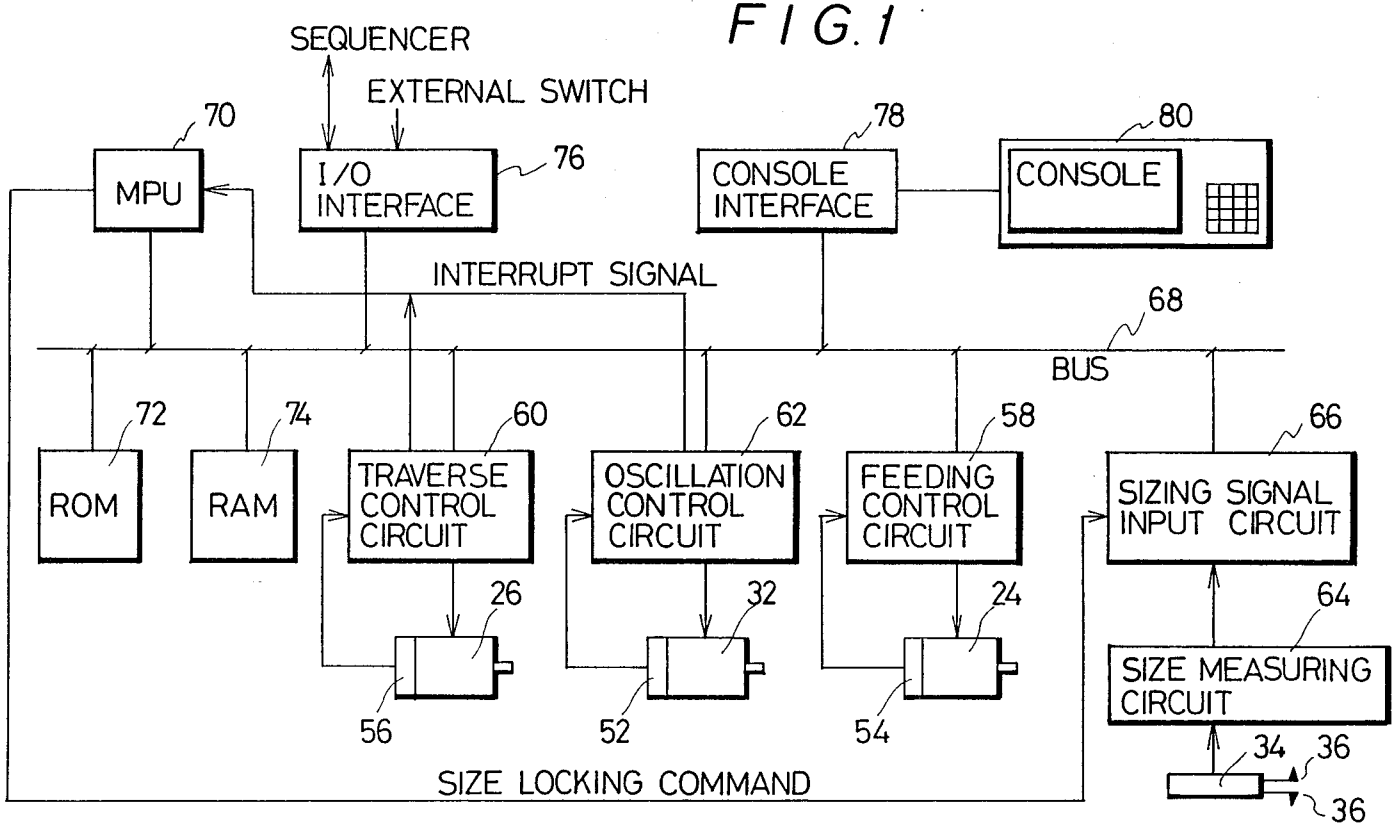
FIG. 1 shows a block diagram of an internal grinder according to one embodiment of the present invention.
Figure 2:
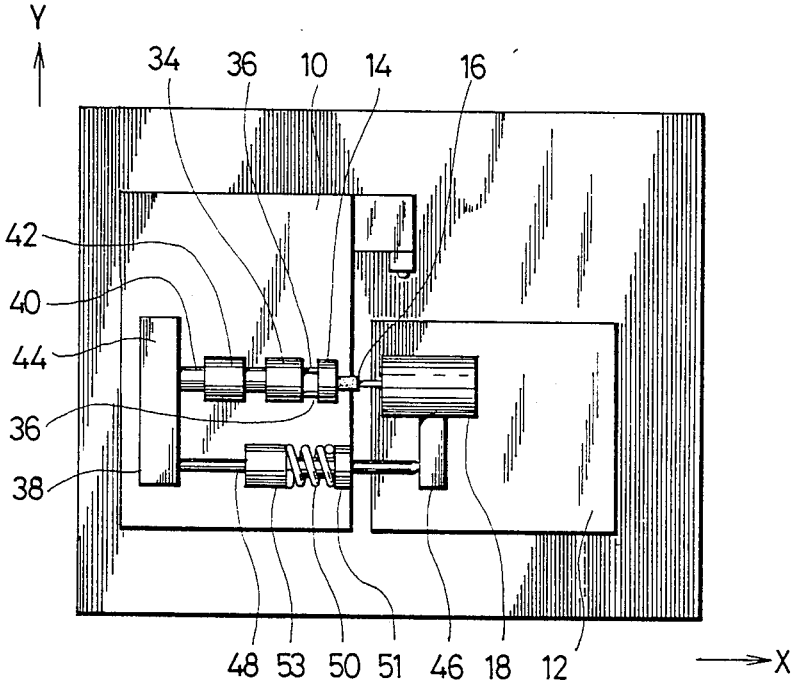
FIG. 2 shows a plan view of an internal grinder according to one embodiment of the present invention.
Figure 12:
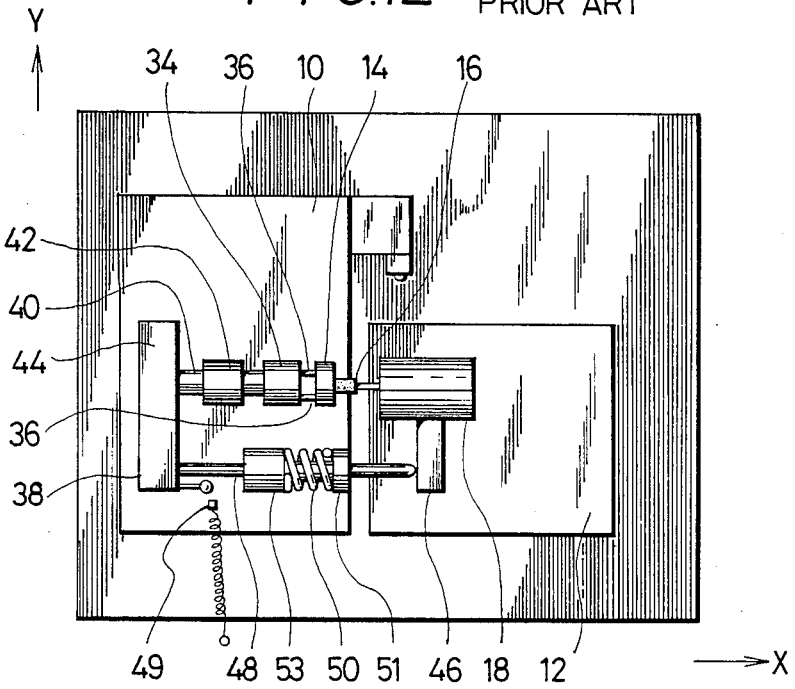
FIG.12 PRIOR ART
FIG. 12 shows a plan view of a conventional internal grinder.
Figure 13:
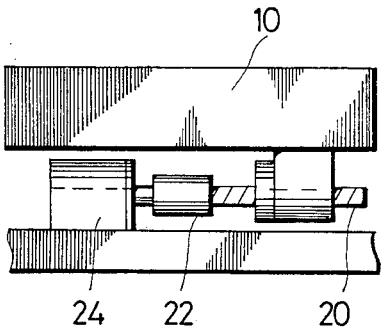
FIG.13 PRIOR ART
FIG. 13 shows a schematic illustration of a drive mechanism of a spindle feeding table of a conventional internal grinder.
Figure 14:
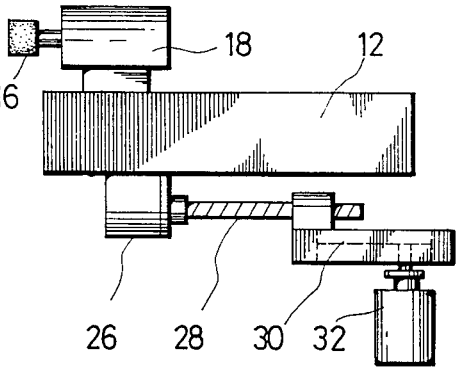
FIG.14 PRIOR ART
FIG. 14 shows a schematic illustration of a drive mechanism of a wheel spindle table of a conventional internal grinder.
Figure 15:
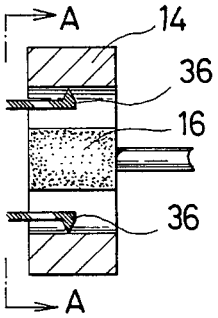
FIG. 15 shows an enlarged cross sectional view of a work piece having relatively large bore.
Figure 16:
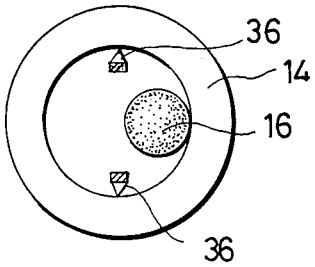
FIG. 16 shows a view along line A—A of FIG. 15.
Figure 17:
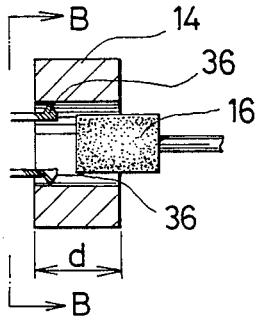
FIG. 17 shows an enlarged cross sectional view of a work piece having relatively small bore.
Figure 18:
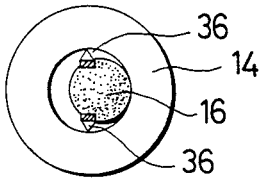
FIG. 18 shows a view along line B—B of FIG. 17.
Figure 19:
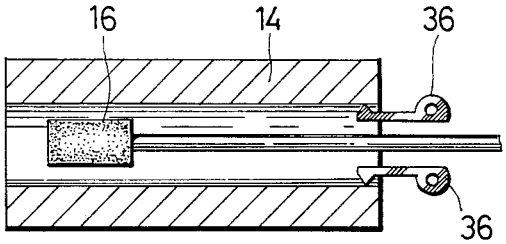
FIG. 19 shows an enlarged cross sectional view of a work piece having long length.
Figure 20:
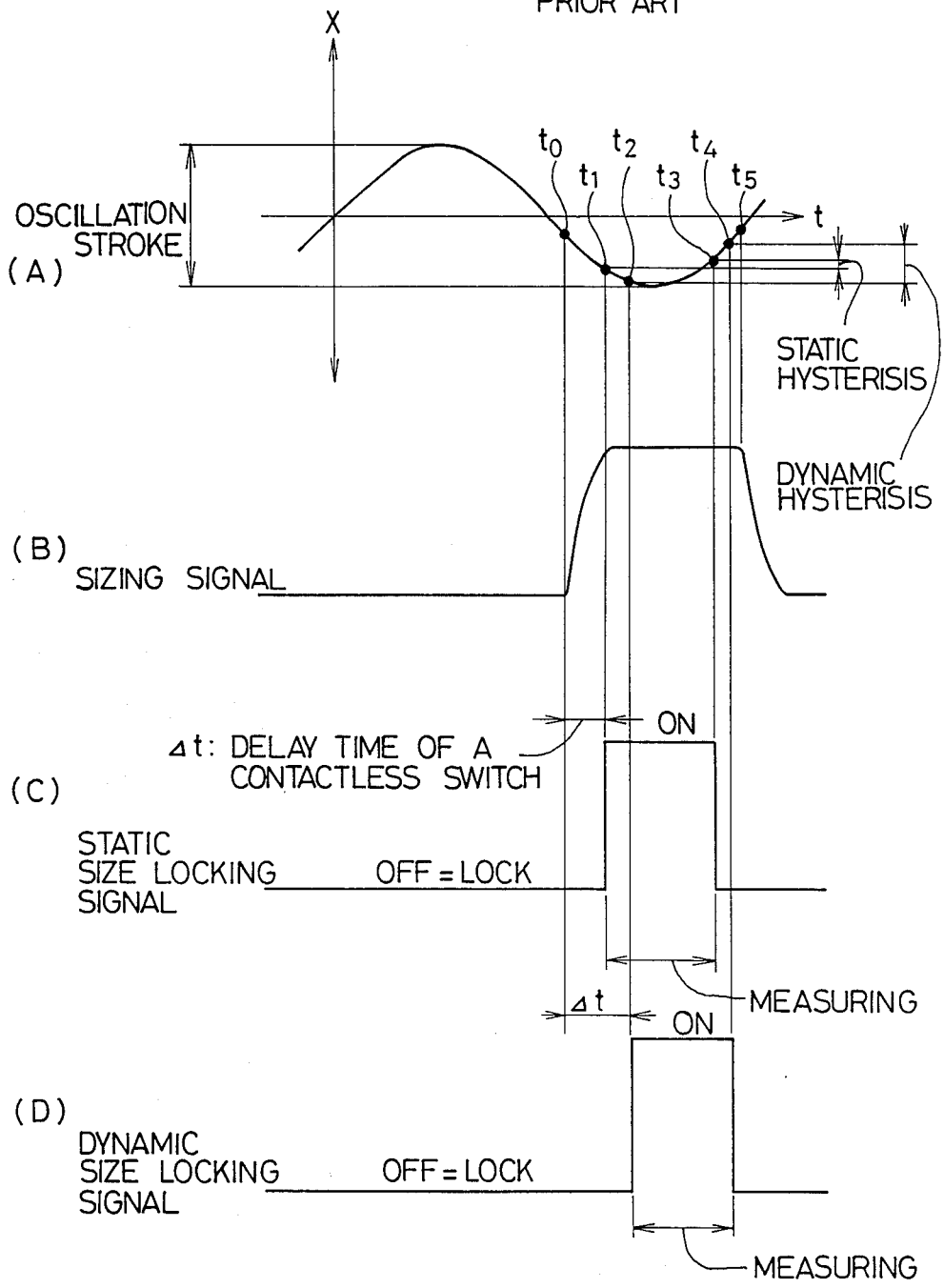
FIG. 20 PRIOR ART
FIG. 20 shows a timing chart explaining functions of a conventional internal grinder shown in FIG. 12.

FIG. 1 shows a block diagram of an internal grinder according to one embodiment of the present invention. FIG. 2 shows a plan view of the internal grinder according to the embodiment, wherein explanations of identically referenced members as those in a conventional internal grinder shown in FIG. 12 are eliminated.

Figure 4:
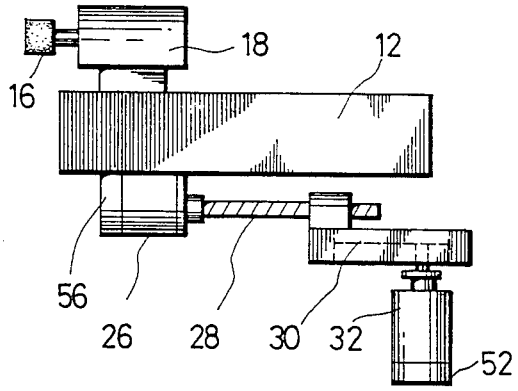
FIG. 4 shows a schematic illustration of a drive mechanism of a wheel spindle table of an internal grinder according to one embodiment of the present invention.

In place of the contactless switch 49, a sensor 52 for sensing a rotation angle of the drive shaft of the oscillation motor 32 is employed in this embodiment as shown in FIG. 4.

Figure 3:
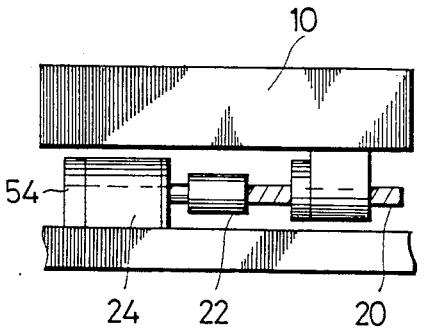
FIG. 3 shows a schematic illustration of a drive mechanism of a spindle feeding table of an internal grinder according to one embodiment of the present invention.

Similar to the oscillation motor 32, a feeding motor 24 and a traverse motor 26 are provided with sensors 54 and 56 for sensing a rotation angle of these drive shafts, respectively as shown in FIG. 3. Sensing pulses of the sensor 54, 56 and 52 are fed to a feeding control; circuit 58, a traverse control circuit 60 and an oscillation control circuit 62 for controlling the feeding motor 24, traverse motor 26 and oscillation motor 32, respectively.

A sizing signal obtained with the sizing device 34 is fed to a size measuring circuit 64, and a value showing a size of the bore of the work piece 14 is fed to a sizing signal input circuit 66 from the size measuring circuit 64 all the time.

The size signal input circuit 66, feeding control circuit 58, traverse control circuit 60 and oscillation control circuit 62 are connected to a bus 68, and the bus 68 is connected to an MPU 70, a ROM 72 and a RAM 74.

An I/O interface 76 and a console interface 78 are also connected to the bus 68. A sequencer and external switches are connected to the I/O interface 76, and a console 80 is connected to the console interface 78.

An interrupt signal is fed to the MPU 70 from the oscillation circuit 62 and the traverse control circuit 60, and a size locking command is given to the sizing signal input circuit 66 from the MPU 70 in correspondence with the size locking signal previously described.

Figure 5:
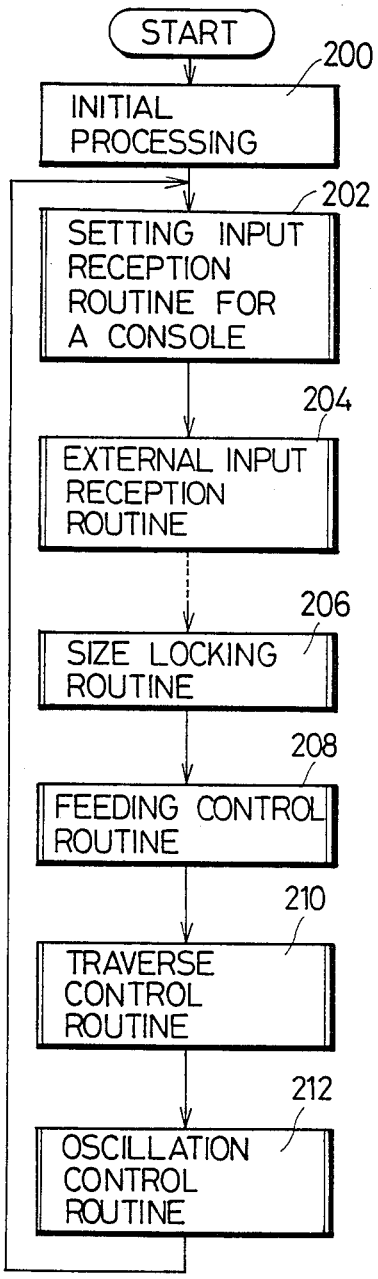
FIGS. 5, 6, 7, 8 and 9 show flow charts explaining processing procedures of an MPU 70 shown in FIG. 1.

In FIG. 5, a flow chart of a general processing performed by the MPU 70 is shown. In this flow chart, a serial processing is repeatedly performed after an initial processing (step 200) with the MPU 70, which processing comprises: a setting input reception routine (step 202) for the console 80, an external input reception routine (step 204), a size locking routine (step 206), a feeding control routine (step 208), a traverse control routine (step 210), and an oscillation control routine (step 212).

Figure 6:
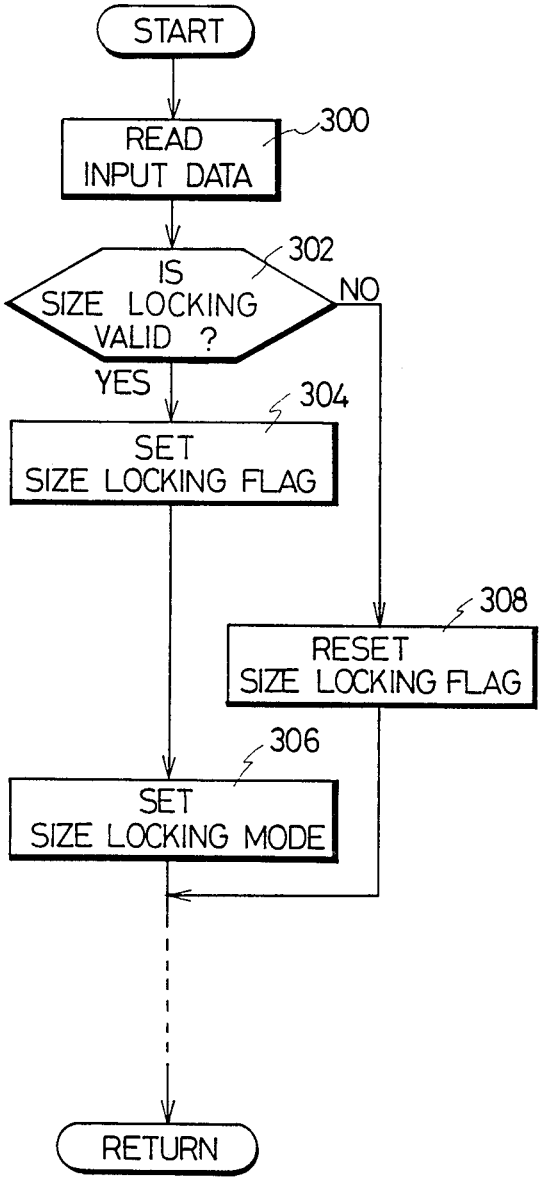

In FIG. 6, the external input reception routine (204) is shown, wherein a command given from the sequencer and external switches is initially read in (step 300).

When the bore of the work piece 14 is confirmed to be measured during an oscillation machining (YES in step 302), a size locking flag is set (step 304), thereby setting a size locking mode (step 306). When such a measuring is not performed (NO in step 302), the size locking flag is reset (step 308).

Figure 7:
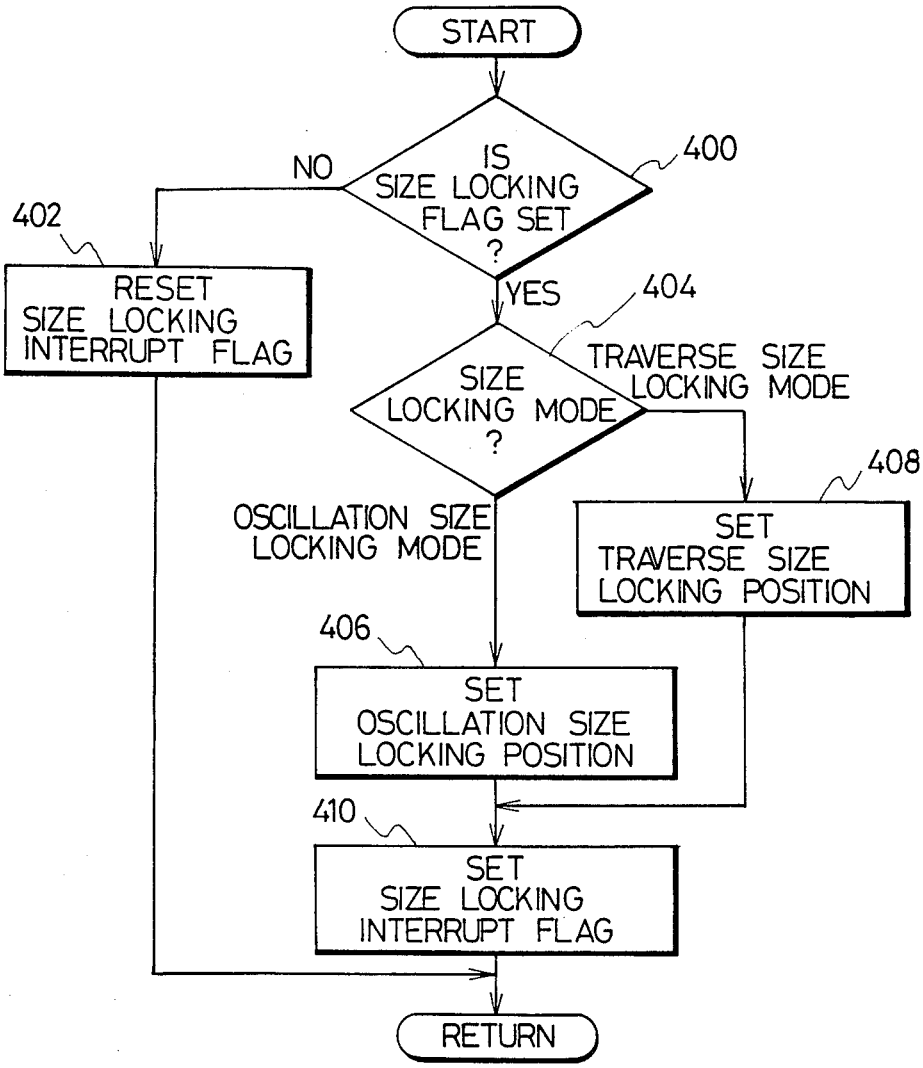

FIG. 7 shows the size locking routine (step 206), wherein the size locking flag is judged whether or not it is set (step 400). When the size locking flag is not set (NO in step 400), a size locking interrupt flag is reset (step 402).

When the size locking flag is set (YES in step 400), the size locking mode already set is judged if it is an oscillation size locking mode or a traverse size locking mode (step 404). In the case of the oscillation size locking mode, an oscillation size locking position is set in the oscillation control circuit 62, and in the case of the traverse size locking mode, a traverse size locking position is set in the traverse control circuit 60 (step 406 and 408), whereby the size locking interrupt flag is set (step 410).

Figure 8:
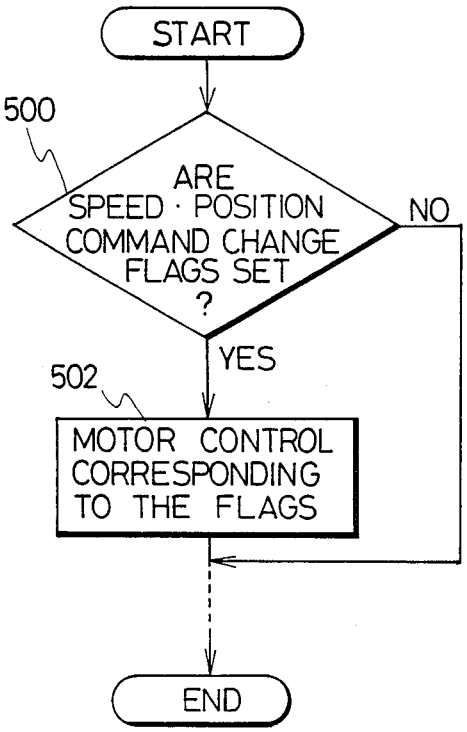

FIG. 8 shows the feeding control routine (step 208). In this processing, a change in flags for a speed command and a position command are confirmed to be set (YES in step 500), processings for controlling the feeding motor 24 are performed in correspondence with these flags (step 502).

Next, in setting processings (step 406 and 408) of the size locking positions in the size locking routine (step 206), the oscillation size locking position is set in the oscillation control circuit 62 and, the traverse size locking position is set in the traverse size control circuit 60. When the drive shafts of the oscillation motor 32 and the traverse motor 26 are rotated and brought to the oscillation size locking position and traverse size locking position, the interrupt signal is fed to the MPU 70 from the oscillation control circuit 62 and the traverse control circuit 60.

Figure 9:
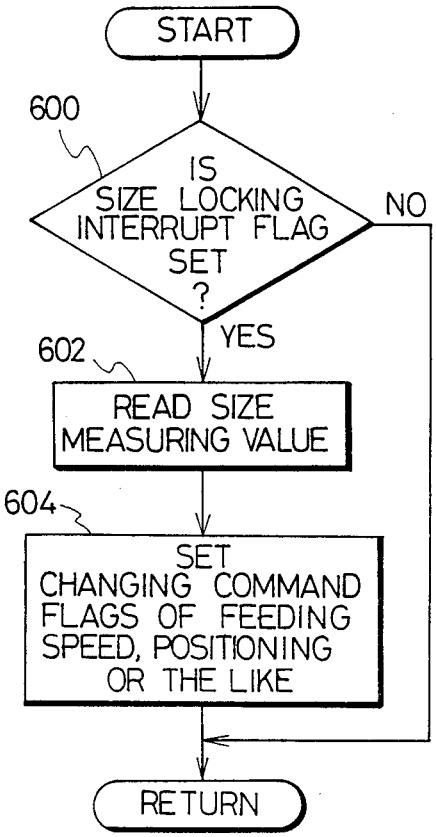

FIG. 9 shows an interrupt processing which is started by the interrupt signal. When the size locking interrupt flag is confirmed to be set (step 600), the size locking command is output into the sizing signal input circuit 66, and a value (the bore of the work piece 14) measured by the size measuring circuit 64 is read in (step 602) by way of the sizing signal input circuit 66, thereby setting flags for changing commands of feeding speed, positioning or the like (step 604).

Figure 10:
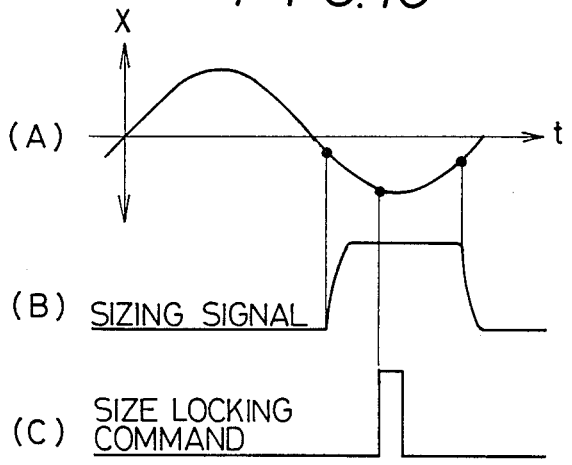
FIGS. 10 and 11 show timing charts explaining functions of an internal grinder according to one embodiment of the present invention shown in FIG. 1.

FIG. 10 shows functions to measure the bore of the work piece during an oscillation machining. As shown in (A) and (B), during a period of time the tips of the forks 36 are contacting the inner peripheral surface of the work piece 14, the size locking command which is depicted in FIG. 10 (C) will be generated.

This size locking command is set with an external input in the size locking routine (step 206); therefore, the setting is arbitrarily made.

The size locking command is generated with reference to a sensing pulse fed by the sensor 52 of the oscillation motor 32. As a result, a value of the bore of the work piece 14 is sampled without a delay of response at a time which is arbitrarily set.

Figure 11:
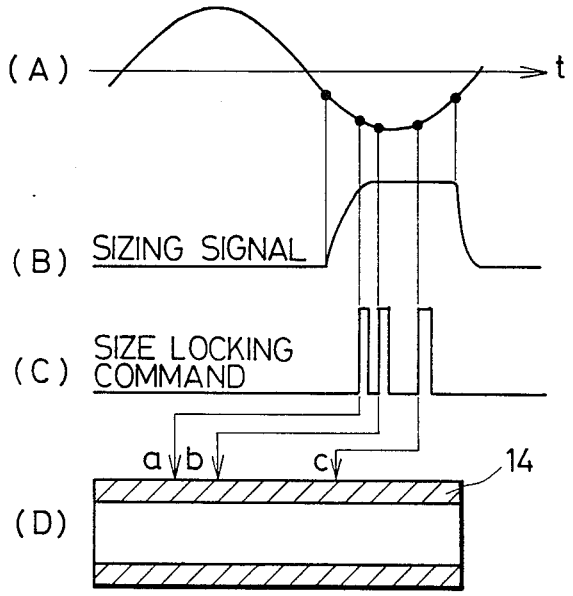

In FIG. 11, functions when the traverse size locking mode is selected are described. In this mode, the inner peripheral surface of the work piece 14 is ground by stroking of the grinding wheel 16 by means of the traverse motor 26, as shown in FIG. 11 (D).

The size locking command is generated when setting positions a, b and c in FIG. 11 (D) during a period of time the tips of the forks are contacting the inner peripheral surface of the work piece 14. The positions a, b and c are also set arbitrarily with external inputs (step 408).

As have been described above, in an internal grinder according to the present invention, the bore of the work piece 14 can be measured during an oscillation machining despite the smallness of the work piece 14 in size in the axial direction thereof, since the bore of the work piece 14 can measured with reference to the sensing pulse of the sensor 52 for sensing a rotation angle of the drive shaft of the oscillation motor 32 and since an encoder or the like having an accuracy higher than that of the conventional contactless switch 49 by two figures can be employed.

In a sizing apparatus for an internal grinder according to the present invention, quality control over products to be manufactured therewith or the like can be performed accurately and simultaneously with a machining of the products.

As have been described above, in a sizing apparatus for an internal grinder according to the present invention, the bore of a work piece can be measured during an oscillation machining despite the smallness of the work piece in size in the axial direction thereof, since a sizing signal can be treated as effective when tips of forks are confirmed to be contacting the inner peripheral surface of the work piece after positions of the tips having been sensed with reference to a rotation angle of the drive shaft of an oscillation motor.

What is claimed is:

1. A sizing apparatus for an internal grinder comprising:

a work table for supporting a workpiece to be machined;

a wheel spindle table mounting thereon a spindle motor with a grinding wheel and movable in an axial direction of a bore in said workpiece;

an oscillation motor for oscillating said grinding wheel for machining an inner peripheral surface of said workpiece including motion converting means for converting rotation of said oscillation motor into oscillation of said wheel spindle table;

a sizing device to generate sizing signals for measuring the bore of said workpiece;

a measuring probe connected to said sizing device and mounted to undergo movement into and out of the bore of said workpiece;

an interlocking mechanism connected to said sizing device and said wheel spindle table to interlock said wheel spindle table relative to the oscillation of said wheel spindle table for inserting or removing said measuring probe of said sizing device into or out of said workpiece;

probe position sensing means having a rotation angle detection sensor and connected to a drive shaft of said oscillation motor for sensing positions of said measuring probe of said sizing device in an axial direction of the bore of said workpiece with reference to a rotation angle of a drive shaft of said oscillation motor; and sizing signal sampling means for sampling sizing signals when the position of said measuring probe sensed by said probe position sensing means is inside the bore of said workpiece.

2. The sizing apparatus for an internal grinder according to claim 1, wherein said measuring probe of said sizing device comprises a pair of forks having tips for contacting an inner peripheral surface of said workpiece.

3. The sizing apparatus for an internal grinder according to claim 1, wherein said motion converting means comprises an eccentric cam connected between the drive shaft of said oscillation motor and said wheel spindle table.

4. The sizing apparatus for an internal grinder according to claim 1, wherein said rotation angle detection sensor comprises a rotary encoder connected to the drive shaft of said oscillation motor for sending detected angle data to an oscillation control circuit.

5. A sizing apparatus for a grinder, comprising:

a work table for supporting a workpiece to be machined;

a spindle table having a spindle motor with a grinding wheel mounted thereon and means mounting the spindle table for movement towards and away from the work table along an axis of the grinding wheel;

means for oscillating the grinding wheel towards and away from a workpiece on the work table including an oscillation motor having a drive shaft and motion converting means for converting the rotation of the drive shaft to oscillation of said spindle table;

means for generating sizing signals for measuring a bore in said workpiece machined by the grinding wheel comprising a measuring probe for contacting an inner peripheral surface of said workpiece to measure the bore diameter and for generating signals corresponding thereto, means interlocking movement of the spindle table and the measuring probe to insert the probe into the bore relative to the oscillation of the spindle table, means for sensing the position of the probe in an axial direction of the base with reference to an angle of rotation of the drive shaft of the oscillation motor including a rotation angle detector connected to the drive shaft, and means for sampling signals from the measuring probe when the measuring probe is sensed to be in the bore of the workpiece, wherein the sampled signals comprise said sizing signals.

6. The sizing apparatus according to claim 5, wherein said measuring probe comprises a pair of forks having tips for contacting an inner peripheral surface of said workpiece.

7. The sizing apparatus according to claim 5, wherein said converting means comprises an eccentric cam connected between the drive shaft of said oscillation motor and said spindle table.

8. The sizing apparatus according to claim 5, wherein said rotation angle detector comprises a rotary encoder connected to the drive shaft of said oscillation motor, and an oscillation control circuit receptive of angle data from the encoder.

* * * * *